US006708812B2

(12) United States Patent
Greim

(10) Patent No.: US 6,708,812 B2
(45) Date of Patent: Mar. 23, 2004

(54) SYSTEM AND METHOD OF ADDING A CURRENCY ACCEPTOR TO A VENDING MACHINE

(76) Inventor: Wade D. Greim, 12 S. 9th St., Perkasie, PA (US) 18944

( * ) Notice: Subject to any disclaimer, the term of this patent is extended or adjusted under 35 U.S.C. 154(b) by 27 days.

(21) Appl. No.: 10/042,423

(22) Filed: Jan. 10, 2002

(65) Prior Publication Data

US 2003/0127300 A1 Jul. 10, 2003

(51) Int. Cl.[7] ..... G07F 9/10; G07F 7/00
(52) U.S. Cl. ..... 194/350; 194/302
(58) Field of Search ..... 194/302, 350, 194/351, 352, 344; 312/107; 221/312 R

(56) References Cited

U.S. PATENT DOCUMENTS 4,020,325 A * 4/1977 Pfost et al. ..... 235/449
4,669,596 A * 6/1987 Capers et al. ..... 194/210
4,966,304 A * 10/1990 Kelly ..... 221/6
5,113,990 A * 5/1992 Gabrius et al. ..... 194/206

FOREIGN PATENT DOCUMENTS

CH 646.001 A5 * 10/1984 ..... G07F/9/00

* cited by examiner

*Primary Examiner*—Donald D. P. Walsh
*Assistant Examiner*—Mark J. Beauchaine
(74) *Attorney, Agent, or Firm*—Lammorte & Associates

(57) ABSTRACT

A system and method for providing a vending machine with the ability to accept both coins and paper currency. The system includes a housing that is mounted to the side of a vending machine. The housing defines an enclosed interior area that is adjacent the vending machine. A door is provided on the housing for selectively accessing the enclosed interior area. At least two access openings are present in the door. A paper currency validation mechanism is mounted in one of the access openings in the door. A coin currency validation mechanism is mounted in a second access opening in the door. Since both the paper currency validation mechanism and the coin currency validation mechanism are mounted to the door of the housing, both mechanisms are removed from the housing when the door of the housing is opened or removed.

16 Claims, 3 Drawing Sheets

SYSTEM AND METHOD OF ADDING A CURRENCY ACCEPTOR TO A VENDING MACHINE

BACKGROUND OF THE INVENTION

1. Field of the Invention

The present invention relates to vending machines and the mechanisms used in vending machines to accept paper and coin currency. More particularly, the present invention relates to supplemental assemblies that are designed to be mounted to vending machines to provide such vending machines with the ability to accept specific denominations of currency.

2. Prior Art Statement

The prior art is replete with different types of vending machines. Vending machines are automated machines that distribute a product or provide a service when the proper amount of money is deposited into the machine. For instance, a cigarette vending machine will distribute a pack of cigarettes when the proper amount of money is inserted into the machine. A jukebox will play a selected song once the required money is inserted into the jukebox.

A problem associated with many vending machines is that they were invented many years ago, when product costs were much lower than they are today. For instance, many cigarette machines were designed to hold cigarettes when a pack of cigarettes cost 0.25¢ per pack. The money box in the vending machine was designed to hold the price of the cigarettes (0.25¢) times the capacity of the machine (100 packs). However, due to taxes and inflation, cigarettes may now cost a few dollars per pack. The money box in the vending machine cannot hold all the coins that would be present if the machine sold its full capacity.

The increasing cost of products also has caused the problem with convenience. The typical person may have a few coins in their pocket of differing denominations. Very few people carry a few dollars in coins with them on a daily basis. As such, a vending machine that requires the use of one or more dollars in coins cannot be used by the average person unless that person first acquires additional change. This added step of having to acquire change greatly reduces the convenience of vending machines and the probability that a person is going to use that vending machine.

To solve the above stated problems, vending machine owners have started adding paper currency validation mechanisms to their vending machines. Paper currency validation mechanisms accept paper money. However, many vending machines were not designed with any extra space into which a paper currency validation mechanism can be placed. As a result, many times the coin acceptance mechanisms of the vending machine is removed or compromised to make room for the paper money validation mechanism. This often denies the vending machine the ability to take both paper money and coin money. It also places the paper currency validation mechanism in a highly cramped location that makes it very hard to remove, repair or otherwise service.

In alternate embodiments, paper currency validation mechanisms are added to the exterior of existing machines. In this manner, they do not have to be jammed into the interior of the vending machine. Such prior art systems are exemplified by U.S. Pat. No. 4,669,596 to Capers, entitled Vending Machine Accessory. A problem associated with such external applications is that the paper currency validation mechanism does not appear to be part of the vending machine. It therefore detracts from the aesthetics of the vending machine and provides an easy target for vandalism and theft. Furthermore, the paper currency validation mechanism may be mounted far from the coin chute and the change return slot. This may cause confusion to patrons that are using both coin money and paper money or to patrons that use paper money and expect change.

Another disadvantage of many paper currency validation mechanisms is that they are designed to take only one type of bills, for instance a one dollar bill. If the design of the currency changes, or if higher bill denominations are to be accepted, the paper currency validation mechanism must be removed and replaced. Alternatively, the paper currency validation mechanism must be reconfigured with new circuit chips that contain the proper programming to accept the new paper currency. The step of replacing or reconfiguring a paper currency validation mechanism is highly labor intensive.

Certain types of vending machines are designed with no coin currency validation mechanism or paper money validation mechanism. Several models of foreign produced jukeboxes are designed to be played for free. In order to convert such free operating machines into vending machines that work for money, some type of money validation system must be attached to the side of the machine. Typically, paper currency validation mechanisms are attached to such vending machines. The paper money validation mechanism is wired to the electronics of the vending machine to only enable the vending machine to be used after a predetermined fee is paid. However, if only a paper currency validation mechanism is attached to the vending machine, coins cannot be used and the vending machine cannot produce change or return money. This is an inconvenience to people who want to use change and a frustration to people who expect change.

A need therefore exists in the art for a system that can add the ability to accept coins and paper currency to a vending machine in a manner that is aesthetically pleasing and easy to use by patrons. A need also exists for a system that can be added to a vending machine to easily enable that machine to accept new types of coins and/or paper currency without the need for labor intensive modifications. These needs are met by the present invention as described and claimed below.

SUMMARY OF THE INVENTION

The present invention is a system and method for providing a vending machine the ability to accept both coins and paper currency. The system includes a housing that is mounted to the side of a vending machine. The housing has a length and width proportional to the vending machine, thereby making the housing seem to be an integral part of the vending machine. The housing defines an enclosed interior area that is adjacent the vending machine. A door is provided on the housing for selectively accessing the enclosed interior area. At least two access openings are present in the door. A paper currency validation mechanism is mounted in one of the access openings in the door. The paper currency validation mechanism receives and validates paper currency. A coin currency validation mechanism is mounted in a second access opening in the door. The coin currency validation mechanism receives and validates coin currency. Since both the paper currency validation mechanism and the coin currency validation mechanism are mounted to the door of the housing, both mechanisms are removed from the housing when the door of the housing is opened or removed.

The present invention system and method provide an assembly that accepts both paper currency and coin currency. The assembly is easy to service and install, thereby improving the ability of a vending machine to accept all types of money and avoid time consuming updates and repairs.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention system can be adapted to many different types of vending machines, the present invention system is especially well suited for use on vending machines that are not designed with any integral coin validation or paper currency validation mechanisms. As such, by way of example, the present invention system will be described in an application where it is applied to the side of a wall mounted jukebox that has no currency validation mechanism of its own. This embodiment is merely exemplary and is illustrated to set forth the best mode contemplated for the invention.

Figure 1:
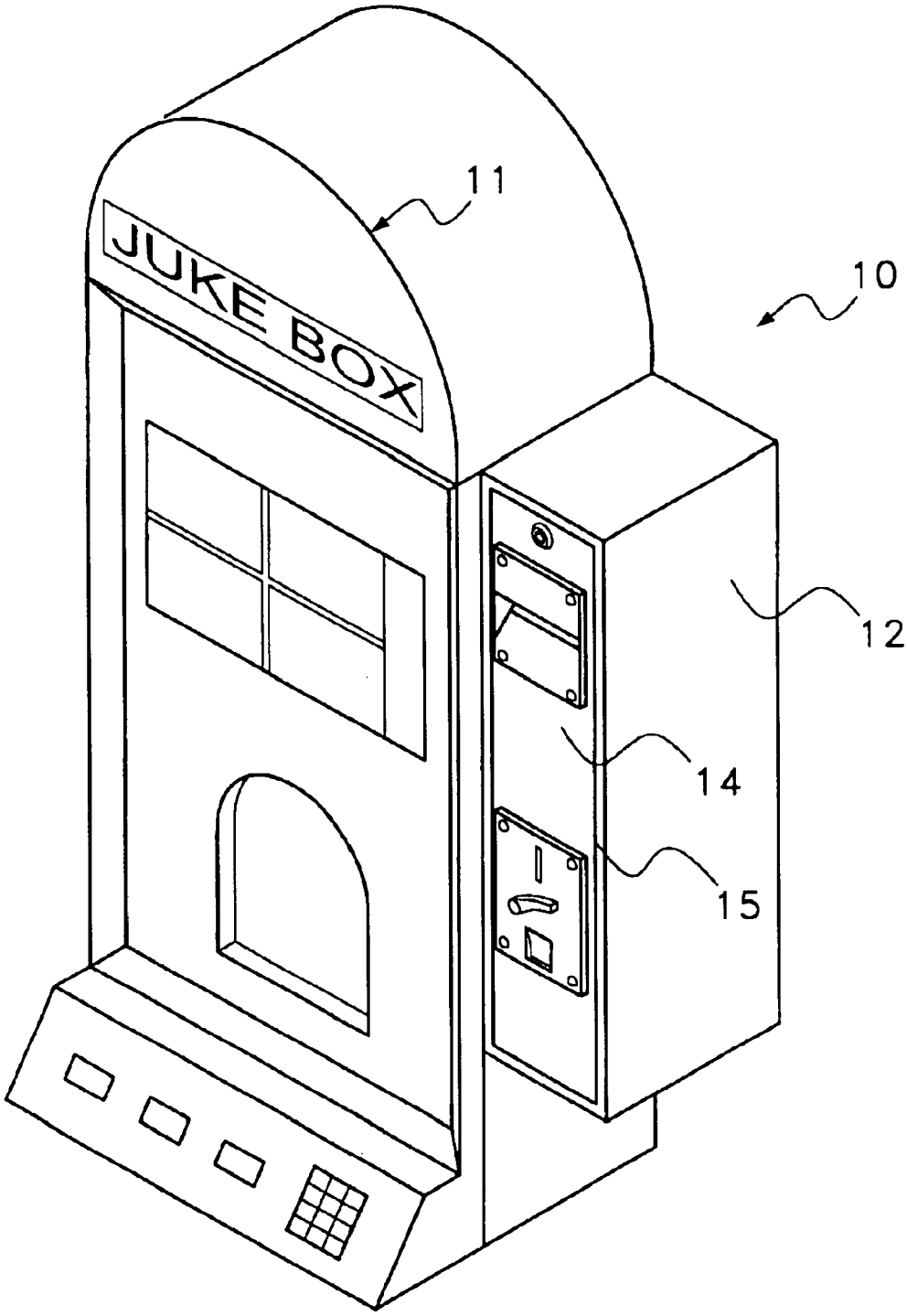
FIG. 1 is a perspective view of a vending machine onto which is attached a currency acceptance assembly in accordance with the present invention.

Referring to FIG. 1, an embodiment of the present invention currency acceptance system 10 is shown mounted on the side of a jukebox 11. The jukebox 11 is one that contains no coin currency validation mechanism or paper validation mechanism of its own. The choice of such a vending machine is merely exemplary and it should be understood that any prior art vending machine can be used. If a prior art vending machine is used that contains its own coin currency validation mechanism or paper currency validation mechanism, these mechanisms can be removed or covered with blank plates.

The present invention currency acceptance system 10 contains a metal housing 12 having a front door 14. The metal housing 12 is rectangular in shape, having a height and a width. The height of the housing 12 can be any length greater than one foot. However, the height of the housing 12 is preferably at least 75% as long as the height of the side of the vending machine 11 to which it is being attached. Furthermore, the width of the housing 12 is preferably the same width as is the width of the main body of the vending machine 11. In this manner, when the housing 12 of the present invention currency acceptance system 10 is mounted to the vending machine 11, the housing 12 appears to be an integral part of the structure of the vending machine 11. Such an appearance is aesthetically pleasing and greatly reduces the likelihood that a vandal will try to pry the housing away from the vending machine 11.

The front surface 15 of the housing 12 is flat and faces in the same direction as does the front of the vending machine 11. The front surface 15 of the housing 12 defines an opening that is covered by a door 14. Two access openings are formed in the door 14. A paper currency validation mechanism 20 is mounted to the door 14 in the higher of the two access openings. A coin currency validation mechanism 22 is mounted to the door 14 in the lower of the two access openings. The paper currency validation mechanism 20 accepts and validates paper currency. The coin currency validation mechanism 22 accepts and validates coin currency.

Figure 2:
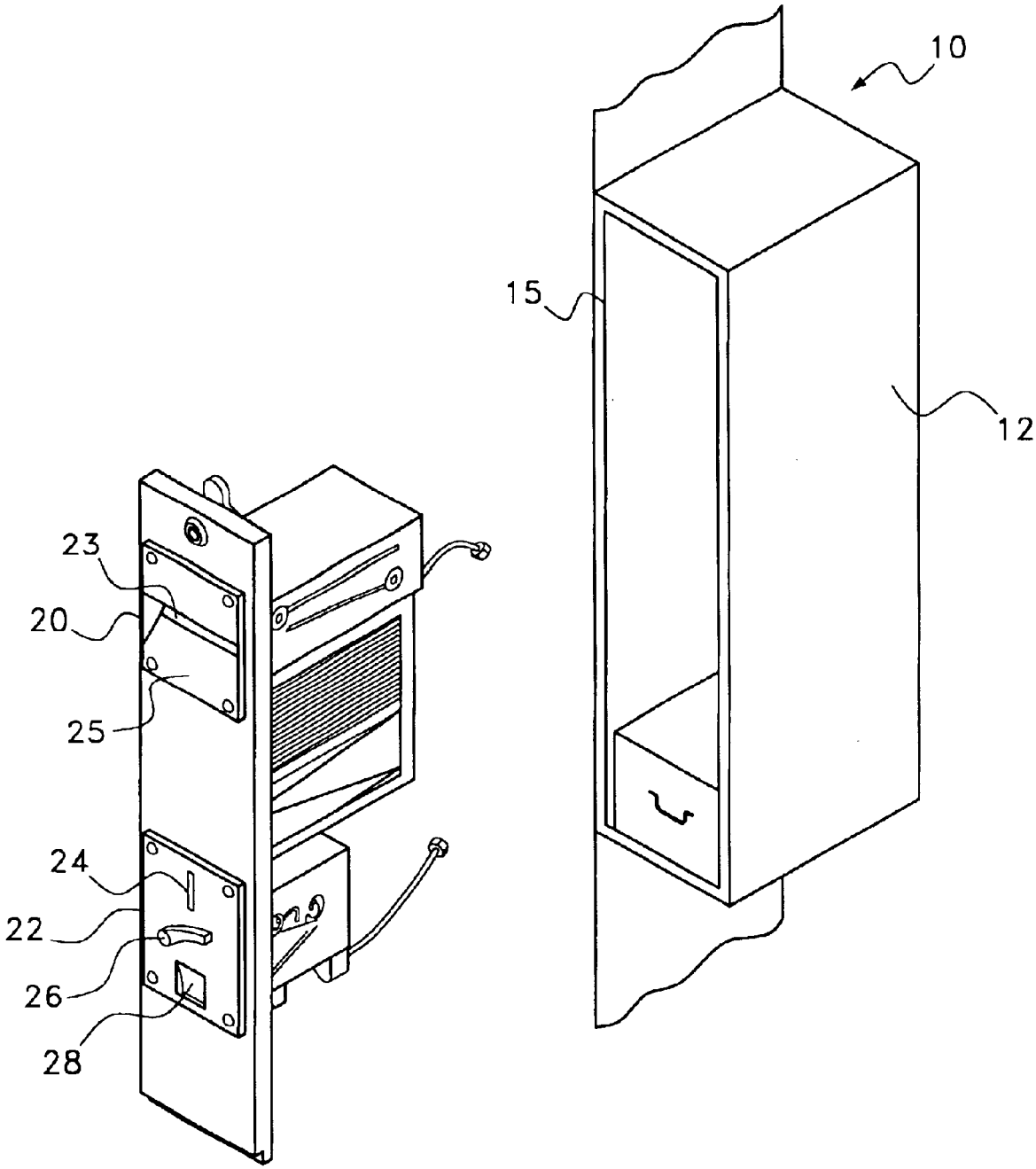
FIG. 2 is an exploded perspective view of the currency acceptance assembly shown in FIG. 1.

Referring to FIG. 2, it can be seen that the door 14 on the housing 12 can be opened or closed. Once closed, the door 14 can be locked into place on the housing 12 and can only be opened by an authorized person with the key. However, since the paper currency validation mechanism 20 and the coin currency validation mechanism 22 are both mounted to the door 14, when the door 14 is opened, both the paper currency validation mechanism 20 and the coin currency validation mechanism 22 are removed from the housing 12

The functional components of the paper currency validation mechanism 20 extend behind the door 14 and are protected in the housing 12 when the door 14 is closed. However, the paper currency validation mechanism 20 has an instructional panel 25 and a money insertion slot 23 that are exposed on the front of the door 14. Similarly, the functional components of the coin currency validation mechanism 22 extend behind the door 14. However, the coin currency validation mechanism 20 has a coin acceptance chute 24, a coin return lever 26 and a coin return window 28 that are exposed on the front of the door 14.

Figure 3:
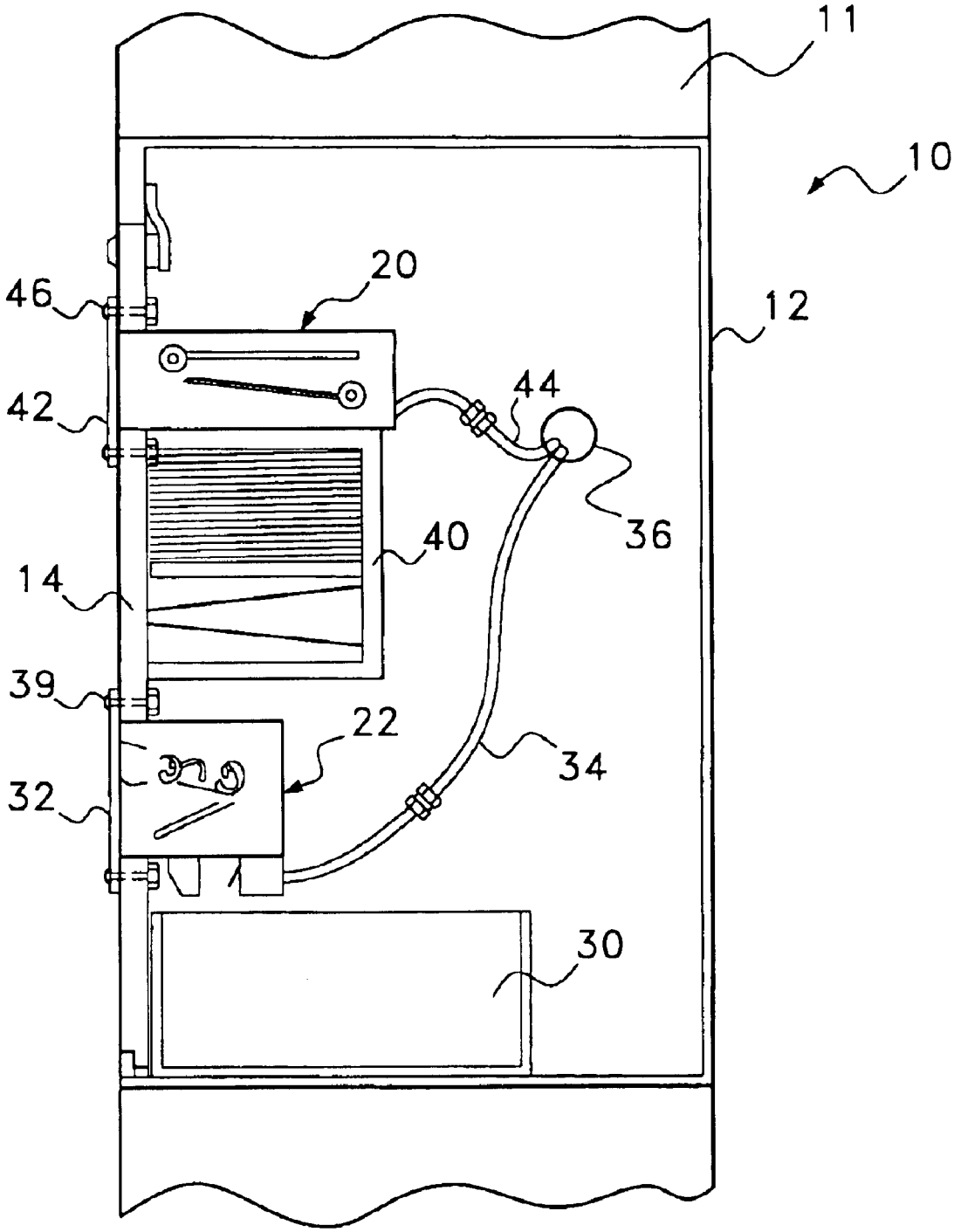
FIG. 3 is a selectively cross-sectioned view of the currency acceptance assembly shown in FIG. 1.

Referring to FIG. 3, it can be seen that inside the housing, the coin currency validation mechanism 22 is mounted to the door 14 a predetermined distance above the base of the housing 12. This elevated height leaves enough space for a coin box 30 to be positioned below the coin currency validation mechanism 22. The coin currency validation mechanism 22 can be any of several commercially available coin currency validation mechanisms, wherein the coin currency validation mechanism 22 validates coins by weight, size and/or magnetic properties. The coin currency validation mechanism 22 can also include optional coin tube chambers so that the coin currency validation mechanism 22 is capable of distributing change when required.

The coin currency validation mechanism 22 is joined to the door 14 of the housing 12 by a front plate 32 that is bolted to the door 14. Power to the coin currency validation mechanism 22 and coin credit signals are carried by a detachable wire cable 34. This wire cable 34 interconnects with the control processor of the vending machine 11 through an access port 36 that interconnects the interior of the housing 12 to the interior of the vending machine 11. As such, it will be understood that the entire coin currency validation mechanism 22 can be removed and replaced by simply removing the wire cable 34 and unbolting the mounting bolts 39 in the front plate 32. Accordingly, a new or an improved coin currency validation mechanism 22 can be added to the assembly 10 should new coins, such as the one dollar coin, be introduced into wide circulation.

The paper currency validation mechanism 20 is disposed a predetermined distance above the coin currency validation mechanism 22. The distance between the paper currency validation mechanism 20 and the coin currency validation mechanism 22 is preferably at least six inches. This leaves room for a bill collection chamber 40 between the paper currency validation mechanism 20 and the coin currency validation mechanism 22. The bill collection chamber 40 stores the paper currency received by the paper currency validation mechanism 20.

The paper currency validation mechanism 20 can be any commercial bill validator, such as a MARS 2000 series bill validator. The paper currency validation mechanism 20 is joined to the door 14 of the housing 12 by a second front plate 42 that is bolted to the door 14. Power to the paper currency validation mechanism 20 and bill processor of the vending machine 11 through the same access port 36 that interconnects the interior of the housing 12 to the interior of the vending machine 11. As such, it will be understood that the entire paper currency validation mechanism 20 can be removed and replaced by simply removing the wire cable 44 and unbolting the mounting bolts 46 in the second front plate 42. Accordingly, a new or an improved paper currency validation mechanism 20 can be added to the system 10 if a new bill is introduced, such as the two dollar bill, or if the design of the bill is changed.

Both the paper currency validation mechanism 20 and the coin currency validation mechanism 22 are mounted to the door 14 of the housing 12. As such, when the door 14 is opened, the paper currency validation mechanism 20 and the coin currency validation mechanism 22 are removed from the housing 14. By detaching the cables 44, 34 from the paper currency validation mechanism 20 and the coin currency validation mechanism 22, the entire subassembly of the door 14, the paper currency validation mechanism 20 and the coin currency validation mechanism 22 can be removed in less than one minute. An entire new subassembly of a different door, paper currency validation mechanism and coin currency validation mechanism can then be installed. This feature is particularly useful to repairmen who service the vending machine 11. Any malfunctioning or obsolete paper currency validation mechanism 20 or coin currency validation mechanism 22 can be quickly removed and replaced. The malfunctioning unit can then be repaired in the shop of the repairman. The downtime of the vending machine 11 and the amount of time the repairman spends at the sight of the vending machine is minimized.

The present invention currency acceptance system 10 provides both a paper currency validation mechanism 20 and a coin currency validation mechanism 22 in a single unit. Both the paper currency validation mechanism 20 and the coin currency validation mechanism 22 are attached to a removable door 14 that can be quickly and easily removed for repairs. The paper currency validation mechanism 20 and the coin currency validation mechanism 22 themselves are attached to the door 14 with front plates 42, 32, respectively. As such, the paper currency validation mechanism 20 and the coin currency validation mechanism 22 can both be individually removed and replaced on the door 14.

The present invention currency acceptance system 10 therefore provides a means by which any vending machine can be provided with the ability to accept both paper money and coins at one convenient location. The system 10 has the capacity to hold a large volume of both coins and paper bills. Accordingly, the system 10 can be added to vending machines, such as candy machines, cigarette machines and the like that are not designed to hold the amount of money they can receive.

It will be understood that the present invention currency acceptance system that is described and illustrated is merely exemplary and a person skilled in the art can make many variations to the shown embodiment. For example, vending machines come in many shapes and sizes. The shape of the housing can be altered to complement the style and shape of the vending machine on which it is attached. All such alternate embodiments and modifications are intended to be included within the scope of the present invention as defined below in the claims.

What is claimed is:

1. A system for providing a vending machine with the ability to accept both coins and paper currency, said system comprising:

a housing defining an enclosed interior area;

a door on said housing for selectively accessing said enclosed interior area, wherein said access door defines at least two access openings;

a paper currency validation mechanism for receiving and validating paper currency, said paper currency validation mechanism being mounting in a first of said access openings in said door;

a coin currency validation mechanism for receiving and validating coin currency, said coin currency validation mechanism being mounted in a second of said access opening in said door, wherein said paper currency validation mechanism and said coin currency validation mechanism are both removed from said housing with the opening of said door.

2. The system according to claim 1, further including a mounting mechanism for mounting said housing to a vending machine.

3. The system according to claim 1, wherein said door is selectively detachable from said housing, wherein said paper currency validation mechanism and said coin currency validation mechanism detach with said door.

4. The system according to claim 1, wherein a bill collection chamber is mounted to said door between said paper currency validation mechanism and said coin currency validation mechanism.

5. The system according to claim 1, wherein said housing has a rectangular box shape with a flat face surface, wherein said door is disposed within said flat face surface.

6. The system according to claim 1, wherein said paper currency validation mechanism includes a face plate that mounts over said first of said access openings in said door.

7. The system according to claim 1, wherein said coin currency validation mechanism includes a face plate that mounts over said second of said access openings in said door.

8. A vending machine system, comprising:

a vending machine having side walls, wherein said vending machine vends a product or service when a predetermined fee is paid;

a money acceptance assembly, for accepting said predetermined fee, said money acceptance assembly including:

a housing that is mounted to a side wall of said vending machine;

a door on said housing;

a paper money currency validation mechanism mounted to said door; and a coin currency validation mechanism mounted to said door.

9. The system according to claim 8, wherein said door is selectively positionable between an open position and a closed position, and both said paper currency validation mechanism and said coin currency validation mechanism are removed from said housing when said door is in said open position.

10. The system according to claim 8, wherein said side walls of said vending machine have a predetermined length and said housing of said money acceptance assembly has a length that is at least as long as 75% of said predetermined length.

11. The system according to claim 10, wherein said side walls of said vending machine have a predetermined width and said housing of said money acceptance assembly has a width equal to said predetermined width.

12. The system according to claim 8, wherein said door is selectively detachable from said housing, wherein said paper currency validation mechanism and said coin currency validation mechanism detach with said door.

13. The system according to claim 8, wherein said vending machine has no paper currency validation mechanism or coin currency validation mechanism other than those present in said money acceptance assembly.

14. A method of adding both paper currency validation mechanism and a coin currency validation mechanism to the exterior of a vending machine, said method comprising the steps of:

providing a housing that defines an enclosed internal area, said housing having a door for selectively accessing said internal area;

mounting a paper currency validation mechanism to said door;

mounting a coin currency validation mechanism to said door;

mounting said housing to said vending machine; and electrically interconnecting both said paper currency validation mechanism and said coin currency validation system to said vending machine.

15. The method according to claim 14, wherein said door is selectively detachable from said housing, wherein said paper currency validation mechanism and said coin currency validation mechanism detach with said door.

16. The method according to claim 14, wherein said step of mounting said housing to said vending machine, includes mounting said housing along the side of said vending machine so that said door of said housing faces in the same direction as said vending machine.

* * * * *